US011466698B2

(12) United States Patent
Gonzalez et al.

(10) Patent No.: US 11,466,698 B2
(45) Date of Patent: Oct. 11, 2022

(54) ELECTROMECHANICAL ACTUATORS FOR REFRIGERANT FLOW CONTROL

(71) Applicant: Danfoss A/S, Nordborg (DK)

(72) Inventors: Delvis Anibal Gonzalez, Tallahassee, FL (US); Mogens Rasmussen, Tallahassee, FL (US)

(73) Assignee: Danfoss A/S, Nordborg (DK)

( * ) Notice: Subject to any disclaimer, the term of this patent is extended or adjusted under 35 U.S.C. 154(b) by 629 days.

(21) Appl. No.: 16/524,428

(22) Filed: Jul. 29, 2019

(65) Prior Publication Data

US 2020/0032813 A1 Jan. 30, 2020

Related U.S. Application Data

(60) Provisional application No. 62/711,749, filed on Jul. 30, 2018.

(51) Int. Cl.

| | |
|---|---|
| ***F04D 29/46*** | (2006.01) |
| ***H01F 7/08*** | (2006.01) |
| ***F04D 29/00*** | (2006.01) |
| ***F04D 17/10*** | (2006.01) |
| ***F25B 31/02*** | (2006.01) |

(52) U.S. Cl.

CPC ..... *F04D 29/464* (2013.01); *F04D 17/10* (2013.01); *F04D 29/002* (2013.01); *F25B 31/026* (2013.01); *H01F 7/081* (2013.01)

(58) Field of Classification Search

CPC ..... F04D 29/464; H01F 7/081; H01F 2007/1669; H01F 2007/1692

See application file for complete search history.

(56) References Cited

U.S. PATENT DOCUMENTS

2016/0208809 A1* 7/2016 Gonzalez ..... F04D 29/464

FOREIGN PATENT DOCUMENTS

EP 580107 A1 * 1/1994 ..... B60L 13/10

* cited by examiner

*Primary Examiner* — J. Todd Newton
*Assistant Examiner* — Brian O Peters
(74) *Attorney, Agent, or Firm* — Carlson, Gaskey & Olds, P.C.

(57) ABSTRACT

An actuator assembly includes a first actuator, a second actuator, and a moving piece that is disposed between the first actuator and the second actuator. The moving piece is positionable to close a gap in the compressor.

13 Claims, 7 Drawing Sheets

ELECTROMECHANICAL ACTUATORS FOR REFRIGERANT FLOW CONTROL

CROSS-REFERENCE TO RELATED APPLICATIONS

This application claims priority to U.S. Provisional Application No. 62/711,749, filed on Jul. 30, 2018.

BACKGROUND

Refrigerant compressors are used to circulate refrigerant in a chiller or heat pump via a refrigerant loop. Refrigerant loops are known to include a condenser, an expansion device, and an evaporator.

This disclosure relates generally to actuators, and more particularly to actuators for refrigerant flow control in a compressor.

SUMMARY

An actuator assembly according to an example of this disclosure includes a first actuator, a second actuator, and a moving piece that is disposed between the first actuator and the second actuator. The moving piece is positionable to close a gap in the compressor.

A centrifugal compressor according to an example of this disclosure includes an impeller, a gap near an exit of the impeller, and an actuator assembly. The actuator assembly includes a first actuator, a second actuator, and a moving piece that is disposed between the first actuator and the second actuator. The moving piece is positionable to close the gap.

In a further example of any of the foregoing, bodies of the first actuator and second actuator are each C shaped in cross section to create a slot, and each slot receives at least one coil.

In a further example of any of the foregoing, each slot receives a second coil.

In a further example of any of the foregoing, the second coils are wound in opposite directions.

In a further example of any of the foregoing, the moving piece includes a channel that is configured to allow refrigerant to leak to the first actuator side.

In a further example of any of the foregoing, permanent magnets are disposed at the moving piece.

A refrigerant system according to an example of this disclosure includes a centrifugal compressor. The centrifugal compressor includes an impeller, a gap near an exit of the impeller, and an actuator assembly. The actuator assembly includes a first actuator, a second actuator, and a moving piece that is disposed between the first actuator and the second actuator. The moving piece is positionable to close the gap.

In a further example of any of the foregoing, an axial thickness of the moving piece is greater than an axial thickness of the gap.

In a further example of any of the foregoing, an axial thickness of the moving piece is about 1 mm greater than an axial thickness of the gap.

In a further example of any of the foregoing, the system is a refrigerant cooling system.

In a further example of any of the foregoing, the system is a heat pump system.

These and other features may be best understood from the following specification and drawings, the following of which is a brief description.

DETAILED DESCRIPTION

Figure 1:
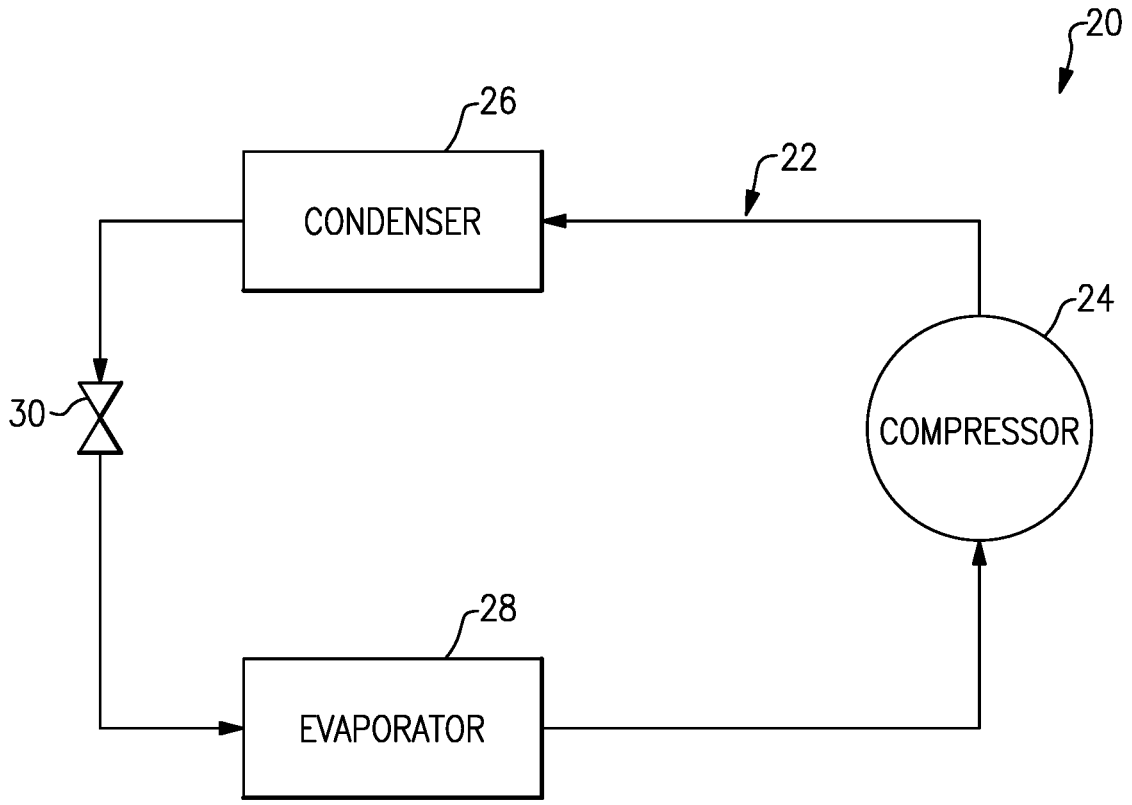
FIG. 1 is a schematic illustration of a refrigerant loop.

FIG. 1 schematically illustrates a refrigerant cooling or heat pump system 20. The refrigerant system 20 includes a main refrigerant loop, or circuit, 22 in communication with one or multiple compressors 24, a condenser 26, an evaporator 28, and an expansion device 30. This refrigerant system 20 may be used in a chiller or heat pump, as examples. Notably, while a particular example of the refrigerant system 20 is shown, this application extends to other refrigerant system configurations. For instance, the main refrigerant loop 22 can include an economizer downstream of the condenser 26 and upstream of the expansion device 30.

Figure 2:
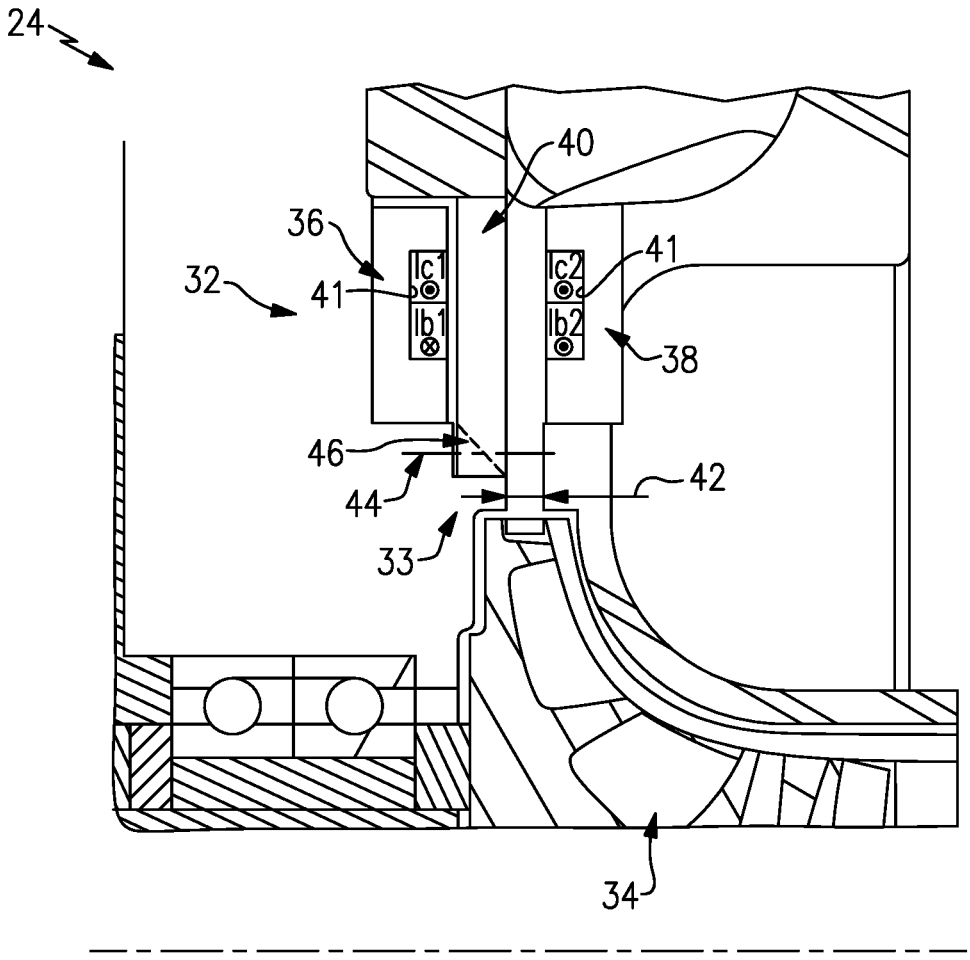
FIG. 2 illustrates a cross sectional view of a portion of a compressor with an example actuator assembly.

FIG. 2 illustrates a cross sectional view of a portion of an example compressor 24, which may be a centrifugal compressor in some examples. An axial actuator assembly 32 is located at an exit 33 of an impeller 34. The axial actuator assembly 32 includes a first actuator 36 and a second actuator 38 with a moving piece 40 located axially between. The body of the first actuator 36 is made of soft magnetic steel and/or "C-shaped" to create a 360 degree circumferential slot 41 in some examples. The slot 41 has two coils, bias coil Ib1 and control coil Ic1, which are wound in opposite directions. The second actuator 38 is constructed similar to the actuator 36, but with the bias coil Ib2 and control coil Ic2 wound in the same direction.

The moving piece 40 is made of soft magnetic steel and/or shaped as a ring in some examples. The axial thickness of the moving piece 40 may be thicker than an axial distance 42 of the throat at the exit 33 in some examples to be able to fully close the throat. In some examples, the axial thickness of the moving piece 40 may be ~1.0 mm thicker than an axial distance 42.

In some examples, the moving piece 40 moves axially along a number (in some examples, three or four) of guides 44 (shown schematically), such as axial displacement bearings in some examples. In some examples, channels 46 (shown schematically) on the inner diameter of the moving ring 40 are machined to allow refrigerant to leak to the first actuator side, as the moving piece 40 moves to close the impeller exit 33. The refrigerant flow between the first actuator 36 and moving piece 40 eliminates the differential pressure at both sides of the moving piece 40.

Figure 3:
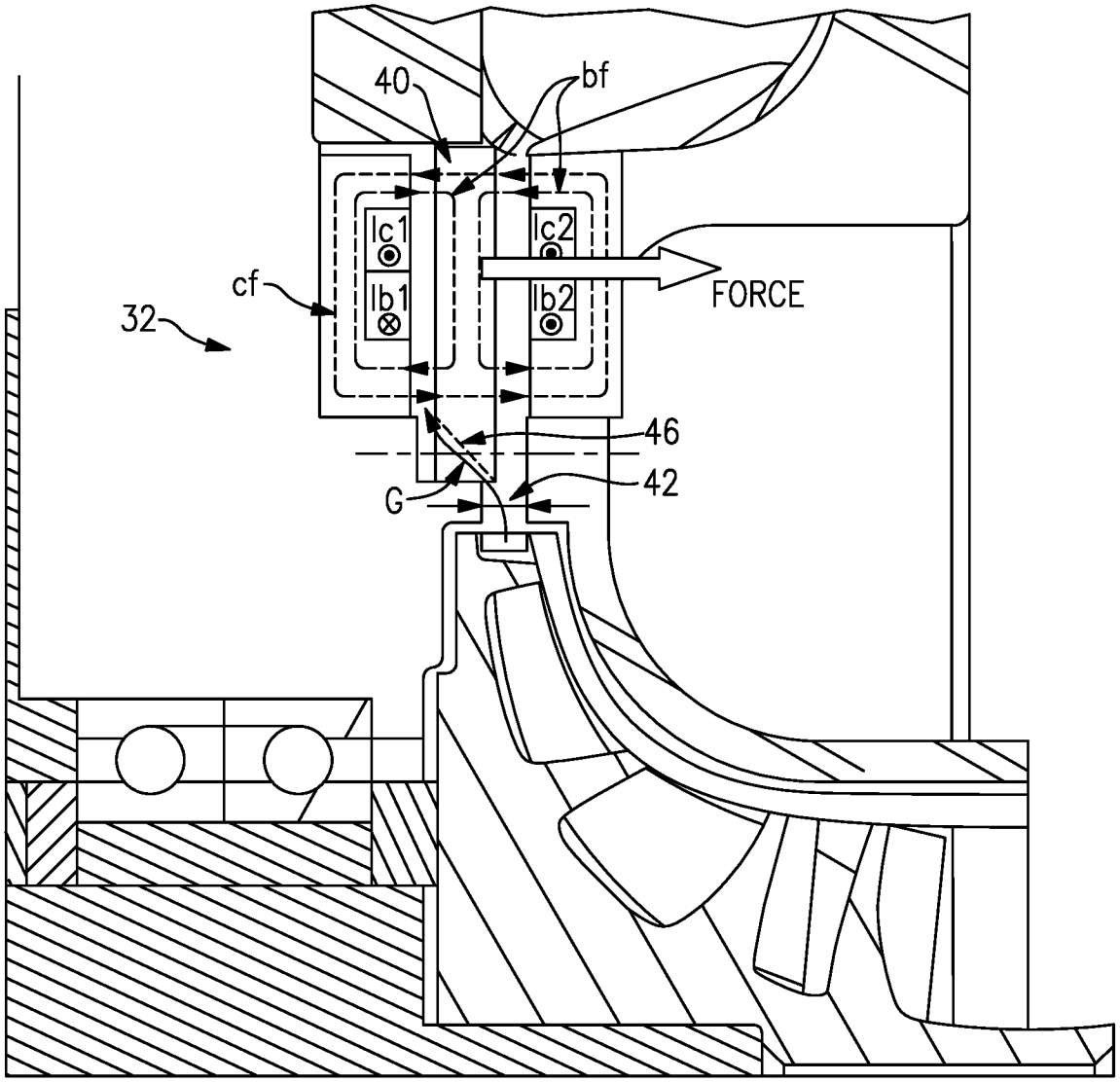
FIG. 3 schematically illustrates the operating principle of the example actuator assembly of FIG. 2.

FIG. 3 schematically illustrates the control and the operating principle of the actuator assembly 32. The magnetic force is created by maximizing the flux density on the side of the moving piece 40 where the pulling force is needed. The bias current has always the same direction, while the direction of the control current is changed according the direction of the magnetic force. FIG. 3 shows the path of the bias flux bf and the path control flux cf to generate a pulling force to close the impeller throat. The pulling force to restrict the flow is generated by maximizing the magnetic flux density on the right, when both the bias and control fluxes have the same direction.

In order to generate a force to open the throat, the direction of the control currents (Ic1 & Ic2) is changed to reverse the direction of the control flux. Then, the control and bias fluxes have the same direction on the left side of the moving piece 40, maximizing the flux density and producing a force pulling the moving piece 40 to the left, with reference to the orientation shown in FIG. 3.

In order to balance the pressure of the gas at both sides when the moving piece 40 is moving to close the throat, the channels on the inner diameter allow the gas to flow as shown schematically at G. With zero differential pressure at both sides of the disk, the actuator needs to generate a force only to overcome the friction of the axial displacement.

The control of the current is intended to be based on the bearing orbit (or FRO value), in which case position sensors may not be needed. However, in some examples, position sensors can be implemented as well to use the position of the moving piece 40 as input to the current control strategy.

Figure 4:
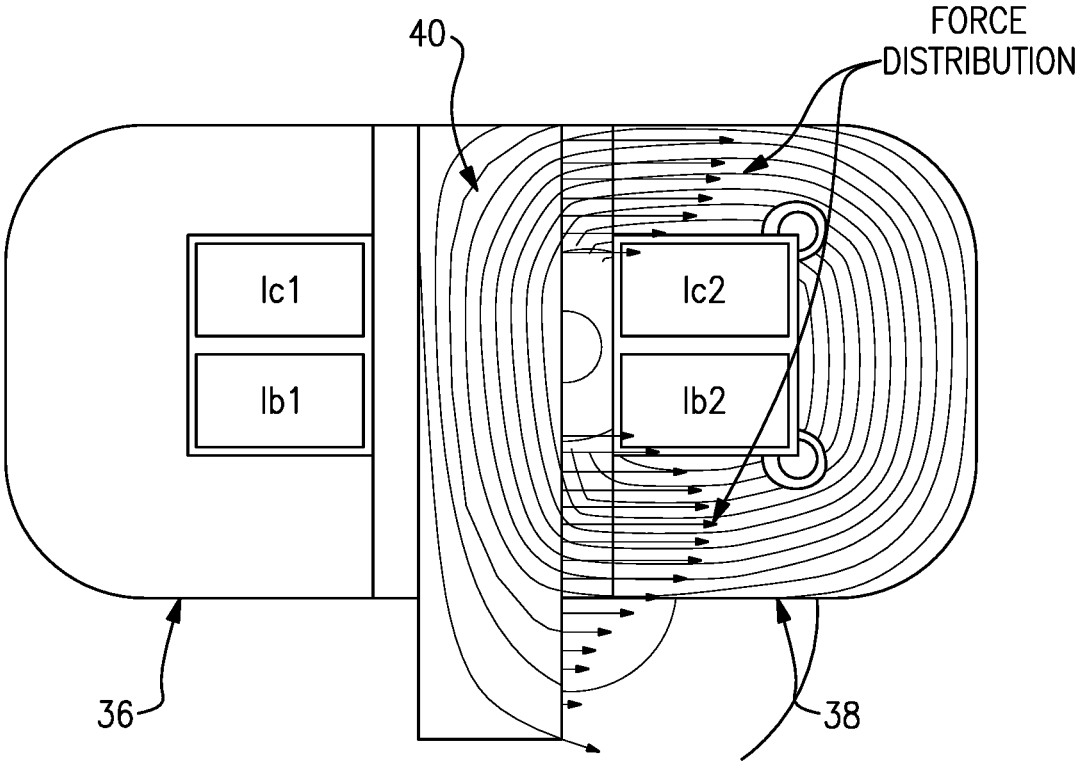
FIG. 4 illustrates a finite element analysis of a flux density distribution and force generated for the example actuator assembly.
Figure 5:
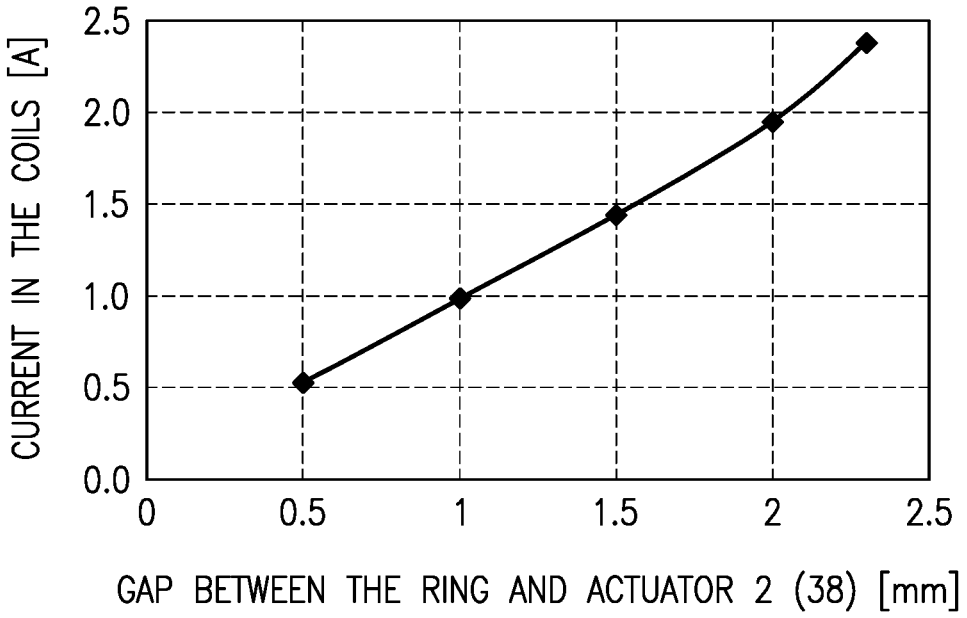
FIG. 5 illustrates a graph of the electric current in the coils versus the distance between the moving piece and the second actuator in the example actuator assembly, to keep constant force along the axial movement.

As shown in FIGS. 4 and 5, a finite element model demonstrates the concept. For a specific application, the design of the actuator assembly 32 can be optimized to meet the force requirements and fit into the space available around the impeller exit. For the case shown it was assumed that the force required to move the moving piece 40 is 50 N, and the dimension 42 in FIG. 2 is 2.3 mm FIG. 4 shows the flux density distribution and force generated, pulling the moving piece 40 to the right.

As the moving piece 40 moves toward the second actuator 38 to close the gap, the current required to keep the 50N pulling force decreases. The graph in FIG. 5 shows the electric current in the coils versus the distance between the moving piece 40 and the actuator 38.

The topology proposed targets minimum cost on components price and manufacturing. The bias flux is provided by a simple rounded coil. However, in some examples, equivalent performance can be obtained by using permanent magnets 148 to generate the bias flux, as shown in FIG. 6.

Figure 6:
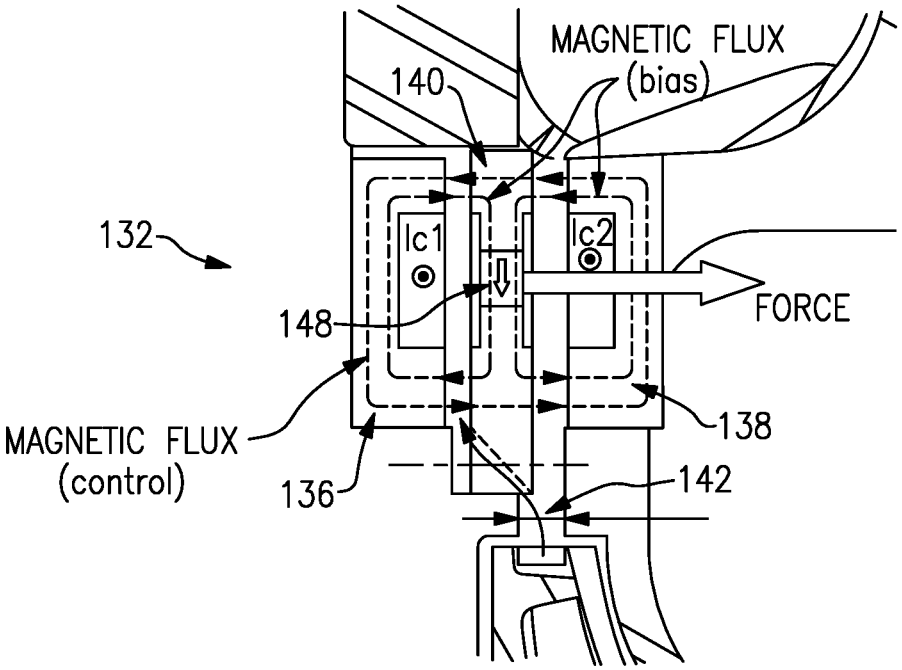
FIG. 6 illustrates another example actuator assembly.

FIG. 6 shows a magnet-biased topology for an actuator assembly 132. It should be understood that like reference numerals identify corresponding or similar elements throughout the several drawings. The topology of the FIG. 6 example utilizes one coil per actuator 136/138, such that two electric coils are to be powered. In some examples a reduced overall volume may be achieved, resulting in a more compact design. In some examples, the gap 142 may be 2.3 mm.

Figure 7:
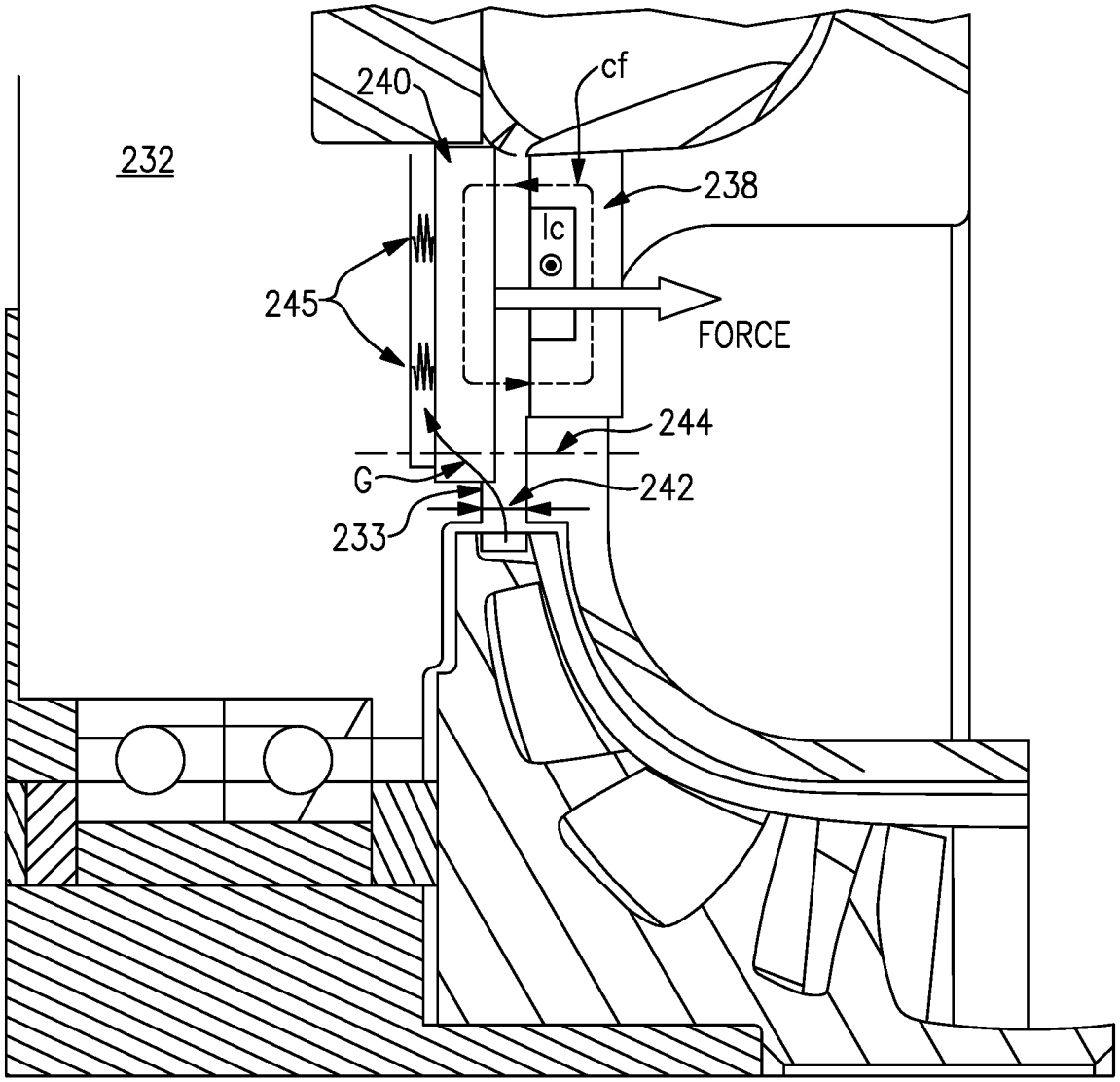
FIG. 7 illustrates another example actuator assembly.

FIG. 7 illustrates another example actuator assembly 232, similar to that of FIG. 6, except that the first actuator 136 may be replaced by springs 245 mechanically attached to the moving piece 240. The springs 245 keep the exit of the impeller 233 opened for very little or zero current in the coil Ic. In order to close the exit of the impeller 233, electric current is injected in the coil Ic to generate a force pulling the moving ring 240 toward the actuator 238.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. An actuator assembly, comprising:
a first actuator;
a second actuator, wherein bodies of the first actuator and second actuator are each C shaped in cross section to create a slot, and each slot receives a first coil and a second coil, the first coils are wound in the same direction as one another, and the second coils are wound in opposite directions from one another; and
a moving piece disposed between the first actuator and the second actuator and positionable to close a gap in a compressor.

2. The actuator as recited in claim 1, wherein the moving piece includes a channel configured to allow refrigerant to leak to the first actuator side.

3. The actuator assembly as recited in claim 1, comprising permanent magnets disposed at the moving piece.

4. A centrifugal compressor comprising:
an impeller;
a gap near an exit of the impeller;
an actuator assembly, comprising:
a first actuator;
a second actuator, wherein bodies of the first actuator and second actuator are each C shaped in cross section to create a slot, and each slot receives a first coil and a second coil, the first coils are wound in the same direction as one another, and the second coils are wound in opposite directions from one another; and
a moving piece disposed between the first actuator and the second actuator and positionable to close the gap.

5. The compressor as recited in claim 4, wherein an axial thickness of the moving piece is greater than an axial thickness of the gap.

6. The compressor as recited in claim 5, wherein an axial thickness of the moving piece is about 1 mm greater than an axial thickness of the gap.

7. The compressor as recited in claim 4, wherein the moving piece includes a channel configured to allow refrigerant to leak to the first actuator side.

8. The compressor as recited in claim 3, comprising permanent magnets disposed at the moving piece.

9. A refrigerant system, comprising:
a centrifugal compressor comprising:
an impeller;
a gap near an exit of the impeller;
an actuator assembly, comprising:
a first actuator;
a second actuator, wherein bodies of the first actuator and second actuator are each C shaped in cross section to create a slot, and each slot receives a first coil and a second coil, the first coils are wound in the same direction as one another, and the second coils are wound in opposite directions from one another; and a moving piece disposed between the first actuator and the second actuator and positionable to close the gap.

10. The system as recited in claim 9, wherein an axial thickness of the moving piece is greater than an axial thickness of the gap.

11. The system as recited in claim 10, wherein an axial thickness of the moving piece is about 1 mm greater than an axial thickness of the gap.

12. The system as recited in claim 9, wherein the system is a refrigerant cooling system.

13. The system as recited in claim 9, wherein the system is a heat pump system.

* * * * *